US008674161B2

(12) United States Patent
Mediaas et al.

(10) Patent No.: US 8,674,161 B2
(45) Date of Patent: Mar. 18, 2014

(54) METHOD FOR ISOLATION AND QUANTIFICATION OF NAPHTHENATE FORMING ACIDS ("ARN-ACIDS")

(75) Inventors: Heidi Mediaas, Heimdal (NO); Knut Grande, Trondheim (NO); Hege Kummernes, Ranheim (NO); Jens Emil Vindstad, Trondheim (NO)

(73) Assignee: Statoil Petroleum AS, Stavanger (NO)

( * ) Notice: Subject to any disclaimer, the term of this patent is extended or adjusted under 35 U.S.C. 154(b) by 34 days.

(21) Appl. No.: 13/380,316

(22) PCT Filed: Jun. 22, 2010

(86) PCT No.: PCT/NO2010/000238

§ 371 (c)(1),
(2), (4) Date: Apr. 12, 2012

(87) PCT Pub. No.: WO2010/151139

PCT Pub. Date: Dec. 29, 2010

(65) Prior Publication Data

US 2012/0190907 A1 Jul. 26, 2012

(30) Foreign Application Priority Data

Jun. 22, 2009 (NO) ..... 20092378

(51) Int. Cl.
*C07C 7/12* (2006.01)

(52) U.S. Cl.
USPC ..... 585/824; 585/820; 585/823; 208/263

(58) Field of Classification Search
None
See application file for complete search history.

(56) References Cited

U.S. PATENT DOCUMENTS

| | | | | |
|---|---|---|---|---|
| 2,003,640 | A * | 6/1935 | Wunsch | 562/511 |
| 2,227,811 | A * | 1/1941 | Moser | 208/263 |
| 2006/0016723 | A1 | 1/2006 | Tang et al. | |
| 2010/0160680 | A1 * | 6/2010 | Levine et al. | 562/511 |
| 2012/0330057 | A1 * | 12/2012 | Levine et al. | 562/498 |

FOREIGN PATENT DOCUMENTS

| | | |
|---|---|---|
| EP | 1840567 | 10/2007 |
| EP | 1870706 | 12/2007 |
| WO | 9943766 | 9/1999 |
| WO | 0218519 | 3/2002 |

OTHER PUBLICATIONS

Simon, S. et al., "Determination of C80 tetra-acid content in calcium naphthenate deposits," Journal of Chromatorgraphy A, Jun. 2008, vol. 1200, No. 2, 136-143, XP022808375.

Brocart, B. et al., "ARN-type naphthenic acids in crudes: analytical detection and physical properties," Journal of Dispersion Science and Technology, 2007, vol. 28, 331-337.

Teixeira, A.M.R. de F. et al., "Extraction and fractionation of petroleum naphthenic acids with solid media," Petroleum Chemistry Division Preprints, 2002, vol. 47, No. 1, 1-3.

Mapolelo, M.M. et al., "Chemical specification of calcium and sodium naphthenate deposits by electrospray ionization FT-ICR mass spectrometry," Energy & Fuels, Jan. 2009, vol. 23, No. 1, 349-355.

Jones, D.M. et al., "Determination of naphthenic acids in crude oils using nonaqueous ion exchange solid-phase extraction," Feb. 2001, Anal. Chem., vol. 73, No. 3, 703-707.

Baugh, T.D. et al., "Characterization of a calcium naphthanate deposit and the ARN acid discovery," 2004, vol. 49, No. 3, 274-276.

Norwegian Search Report in Norwegian Patent application No. 20092378, issued Jan. 20, 2010.

* cited by examiner

*Primary Examiner* — Tam M Nguyen
(74) *Attorney, Agent, or Firm* — Volpe and Koenig, P.C.

(57) ABSTRACT

A method for isolation and quantification of naphthenate forming acids (ARN-acids) in crude oils is disclosed. The method involves selective absorbtion/adsorption of ARN acids by a solid medium. Isolation of the solid medium and transferring the ARN acids to an organic solvent which can by analysed for its ARN acid content.

12 Claims, 7 Drawing Sheets

METHOD FOR ISOLATION AND QUANTIFICATION OF NAPHTHENATE FORMING ACIDS ("ARN-ACIDS")

The present invention relates to a method for isolation and quantification of naphthenate forming acid in crude oil.

Crude oils may contain different quantities of naphthenic acids. Statoil and ConocoPhillips have previously published the discovery that among these acids the naphthenate forming acids also known as the ARN acid family, are a universal prerequisite for- and main ingredient of calcium naphthenate deposits see Baugh, T. D.; Grande, K. V.; Mediaas, H.; Vindstad, J. E.; Wolf, N. O., "Characterization of a Calcium Naphthenate Deposit—The ARN Acid Discovery." *American Chemical Society, Petroleum Chemistry Division Preprints* 2004, 47, (1) and Baugh, T. D.; Grande, K. V.; Mediaas, H.; Vindstad, J. E.; Wolf, N. O. "The Discovery of High Molecular Weight Naphthenic Acids (ARN Acid) Responsible for Calcium Naphthenate Deposits", SPE 7th International Symposium on Oilfield Scale, 11-12 May, Aberdeen, United Kingdom, Society of Petroleum Engineers, 2005.

Accordingly, to be able to obtain a reliable estimate of the amount of calcium naphthenate deposits one may expect from a crude oil and design appropriate naphthenate management strategies, it is important to know not the amount of naphthenic acids but the amount of ARN-acids present in the crude oil.

ARN-acids are present in crude oils of different origin in different amounts.

Naphthenate deposition has been subject for a number of publications over the last years.

EP1840567 discloses a crude oil screening process which includes a quantification of naphthenic acids, the process does not involve a separation of ARN-acids from the other naphthenic acids with high molecular weight. It is further disclosed that the results may be used in an indirect method for estimating the naphthenate deposition potential for crude oils.

Simon S. et. Al., "Determination of C80 tetra-acid content in calcium naphthenate deposits", Journal of Chromatography A, June 2008, Vol. 1200, No. 2 pages 136-143, disclose a method of analysing naphthenate deposits based on that ARN-acids are the dominating acid in these deposits. In crude oils ARN-acids only constitute a very small part of the total content of acids, normally less than 100 ppm.

Benjamin Brocart, Maurice Bourrel, Christian Hurtevent, Jean-Luc Volle, Bernard Escoffier (2007) "ARN-Type Naphthenic Acids in Crudes: Analytical Detection and Physical Properties", Journal of Dispersion Science and Technology 28(3): 331-337, disclose a method for the detection of the presence of ARN acids in crude oils. The disclosed method is based on replication of the natural process for formation of naphthenate. However none of the disclosed methods are described as being selective and quantitative results are not obtained.

Until now no technology exists to quantify the amount of the naphthenate-forming ARN acids in crude oils. However due to there important role in formation of deposits there is a need for such knowledge for developing efficient naphthenate management strategies for oil fields in planning and operational phases.

The aim of the present invention is to provide such a method for the quantification of ARN acids. A further aim is to provide a method with high selectivity towards ARN-acids.

The present invention provides a method to determine the concentration of ARN acids in crude oils. The method for isolation and quantification of ARN acids in an crude oil sample is characterized by the following steps:

a) bringing the crude oil sample in contact with a solid ARN absorption/adsorption medium,
b) separating the solids from the remaining crude oil sample after the ARN acids have been absorbed by or adsorbed on the solids,
c) washing the solids with an organic solvent,
d) bringing the solids in contact with a mixture of acidified water or other acid and an organic solvent to release the ARN acids into the organic solvent,
e) separating the organic phase from the remains of the solids and any aqueous or other acid used in step d),
f) optionally derivatising the ARN acids to esters or other non-acids,
g) quantification of the ARN acids in the organic phase.

In one embodiment the method further comprises diluting the crude oil sample before it is brought in contact with the solid selective ARN absorption medium. The organic solvent utilized in the method is in one embodiment toluene or xylene, at least a part of the organic solvent may be removed before step g) or optionally step f) is performed. Further step d) may be repeated one or more times before step e) is performed.

In one aspect of the invention the solid ARN absorption/adsorption medium is selected from the group consisting of hydroxides of alkaline earth metals, alkali metals, and transition metals. In another aspect the solid ARN absorption/adsorption medium is oxides of alkaline earth metals, alkali metals, and transition metals. In yet another aspect the solid ARN absorption/adsorption medium is selected from the group consisting of carbonates or bicarbonates of alkaline earth metals, alkali metals and transition metals, other basic transition metal salts, silica, modified silica, or sephadex. In one embodiment the solid ARN absorption medium is $Ca(OH)_2$.

In yet another aspect of the method according to the present invention the solids are dissolved in step d).

Other embodiments and further features of the present invention are disclosed in the enclosed dependant claims.

The method for quantification of ARN-acids according to the present invention involves selective absorption of ARN acids by a solid medium. Isolation of the solid medium and transferring the ARN acids into an organic solvent which can by analysed for its ARN acid content. According to the present invention the ARN-acids are isolated from all other acids present in crude oil. The method according to the present invention transfers mainly all ARN-acids to the solid medium and the ARN-acids are released from the solid medium in step d).

In a preferred embodiment the solid medium is $Ca(OH)_2$. In this case, enough aqueous acid is added during the transfer of ARN acids to an organic solvent step to dissolve the solid medium. When the absorption medium is dissolved in the presence of a hydrophobic ARN solvent, all ARN acids are dissolved and transferred to the hydrophobic solvent and all the calcium ions and the reacted acid remain in the aqueous phase.

This invention is the first technology of its kind which can quantify the amount of ARN acids in crude oil sample.

The present invention will be described in more detail with reference to the enclosed figures where:

FIG. 1*a* shows the negative ion mass spectra of crude oil including ARN acids;

FIG. 1*b* shows the spectra after the ARN acids have been isolated into a separate organic solvent using the present method;

Figure 1A:
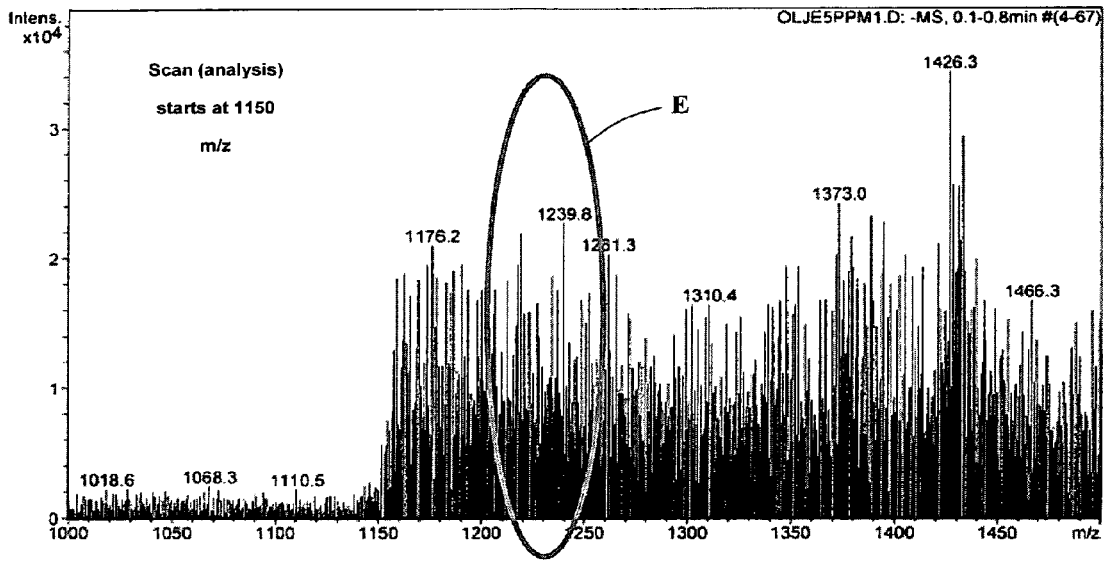

In a preferred embodiment the process according to the present invention includes the steps:

1. Optionally diluting at least a part of the oil sample to be analysed. The diluent can be toluene or another suitable diluent such as xylene, benzene, pyridin etc. The diluent/oil ratio will normally be 1, but may be higher for viscous oils. If the oil is very light/has very low viscosity, dilution may not be necessary.
2. Contacting the oil or oil-diluent mixture with a solid medium which has the property of selectively absorbing or adsorbing the ARN acid. This solid medium can be selected from the group consisting of hydroxides and oxides of alkaline earth metals, transition metals, such as Sc or other Group Mb elements, Ti or other Group IVb elements, V or other Group Vb elements, Cr or other Group VIb elements, Mn or other Group VIIb elements, Fe or other Group VIIIb elements, Cu or other Group Ib elements, and Zn or other Group IIb elements; and alkali metals; carbonates or bicarbonates of alkaline earth metals, such as $CaCO_3$, carbonates or bicarbonates of alkali metals such as $NaHCO_3$ and carbonates or bicarbonates of transition metals, such as $FeCO_3$; other basic transition metal salts, silica, modified silica, sephadex or similar.

In one embodiment the solid medium is selected among, alkaline earth hydroxides (e.g., $Ca(OH)_2$, $Sr(OH)_2$ or $Ba(OH)_2$), alkaline earth oxides (e.g., CaO, SrO), alkaline earth carboxides (e.g., $CaCO_3$), bicarbonates of alkali metals such as $NaHCO_3$, basic transition metal salts (e.g. $Fe(OH)_2$, $Fe(OH)_3$, or $FeCO_3$), other transition metal salts such as metal halides (e.g. $FeCl_3$) or sepadex. In another embodiment the solid medium is $Ca(OH)_2$, $Sr(OH)_2$, CaO or SrO. In yet another embodiment the solid medium is $Ca(OH)_2$.
3. Separation of the solids from the liquids, after a certain contact time. Usually the contact time will be from a few seconds to several days depending on the analytical equipment set-up.
4. Removing most of the oil components other than the ARN acid from the solid phase using toluene or a mixture of toluene and 2-propanol. Other washing agents, such as heptane, xylene or others, may be required for certain oils.
5. Contacting the solid phase, which now contains the ARN acids originally present in the sample, with a mixture of acid (aqueous or other) and a volatile ARN acid solvent (e.g., toluene, xylene, benzene, other organic solvents including mixtures). This step serves to transfer the ARN acids from the solid phase to the organic solvent. If $Ca(OH)_2$ or another basic salt is used as solid extraction medium, enough acid must be used to dissolve the whole solid phase through the reaction $$Ca(OH)_2+2H^+ \rightarrow Ca^{2+}+2H_2O$$

or equivalent for other basic salts. This step must be repeated until all the ARN acids are transferred to the organic solvent phase. Applicable acids are inorganic acids (HCl, $H_2SO_4$ or other), water-soluble organic acids such as formic- and acetic acid, or other acidic substances.
6. Separating the organic phase from the aqueous phase, ensuring that any ARN acid in the interface follows the organic phase.
7. The amount of organic solvent is optionally reduced by evaporation or otherwise until the ARN concentration is suitable for quantification. The Arn acids may also optionally be derivatised, e.g., to esters, before quantification.
8. The ARN- or ARN derivative concentration is quantified using e.g. mass spectroscopy (MS), gas chromatography (GC), Ultra-Violet light absorption (UV), or any other suitable method.

The amount of ARN in the organic solvent is quantified, e.g., using one of the techniques mentioned under step 8 or by means of other analytical techniques—direct or indirect. The ARN concentration in the original crude oil is calculated from the result from step 8, considering all dilution and concentration steps undertaken as part of the procedure.

Figure 1B:
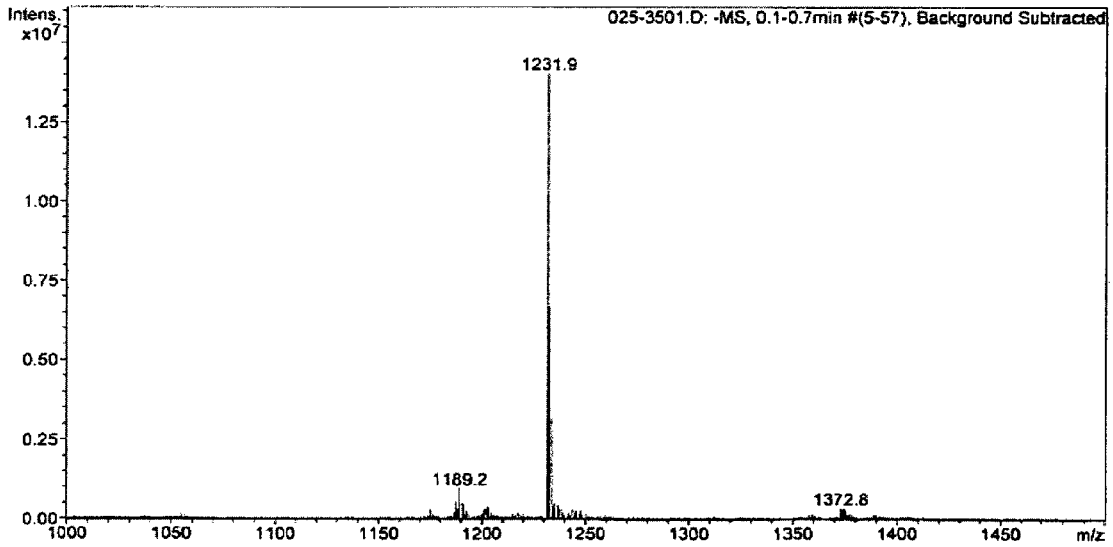

FIGS. 1*a* and 1*b* show mass spectra of naphthenic acids extracted from a crude oil spiked with 5 ppm ARN acids. FIG. 1*a* shows the acid spectrum prior to application of the present method and FIG. 1*b* shows the spectrum of the solvent after application of the present method (i.e., after step 7 above). The grey ellipse E in FIG. 1*a* indicates mass area where the ARN acid is located. As evident from the figure, resolving the response from the ARN acid from other acids in the same mole weight area without physically isolating the ARN acid first is not straight forward. The present invention provides this possibility as illustrated in FIG. 1*b*.

The selectivity of the solid absorption medium is important for the quantification of ARN-acids.

Figure 2:
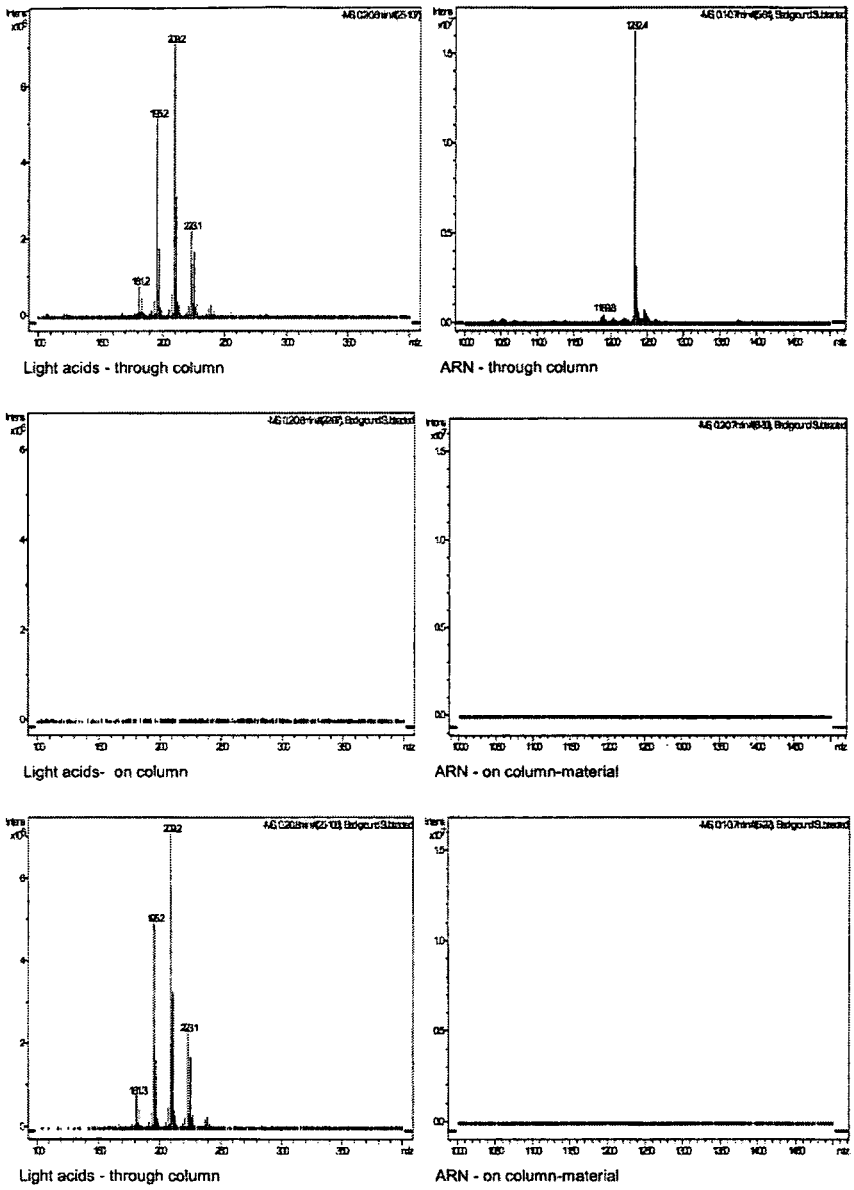
FIG. 2 shows the evaluation of different solid media.

The applicability of different types of solid media in the method disclosed here have been tested, the evaluation of the these tests are illustrated in FIG. 2. The figure shows the MS spectra of hydrocarbon solvent containing both low molecular weight carboxylic acids (LMW acids) and ARN acids after the solution has passed through the absorbent column filled with different absorbents (solid media). The spectra on the left hand side cover the LMW acids while those on the right hand side cover the ARN acids. In the top row example, both LMW acids and ARN acids are found in the solvent, indicating that the absorbent is ineffective for both acid types; i.e., no separation of the two is obtained. In the middle row, neither LMW acids nor ARN acids are detected in the solvent, indicating that the absorbent is effective for both the LMW acids and the ARN acids; i.e., no separation of the two is obtained. In the bottom row, only LMW acids are found in the solvent, indicating that the absorbent is effective only for the ARN acids; i.e., the two acid types are separated and the ARN acids may be quantified in subsequent steps as described in the method.

Figure 3:
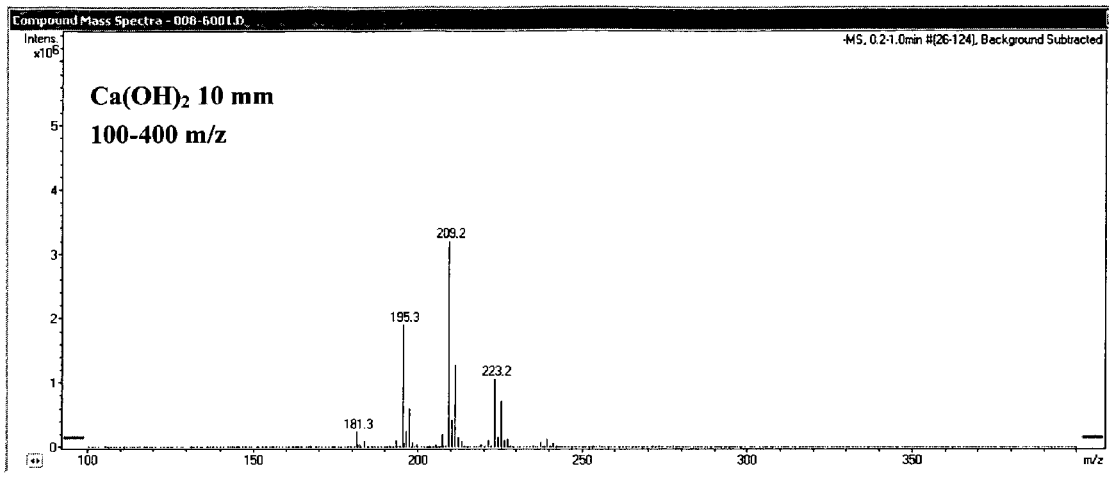
FIG. 3 shows the mass spectrum of a solution comprising ARN acids and lighter acids after it has passed through 10 mm $Ca(OH)_2$.
Figure 3:
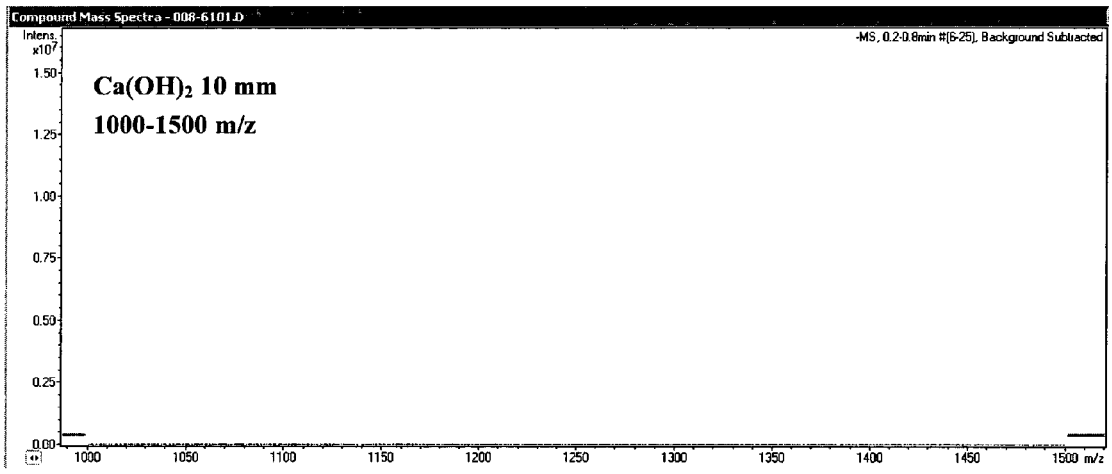
Figure 4:
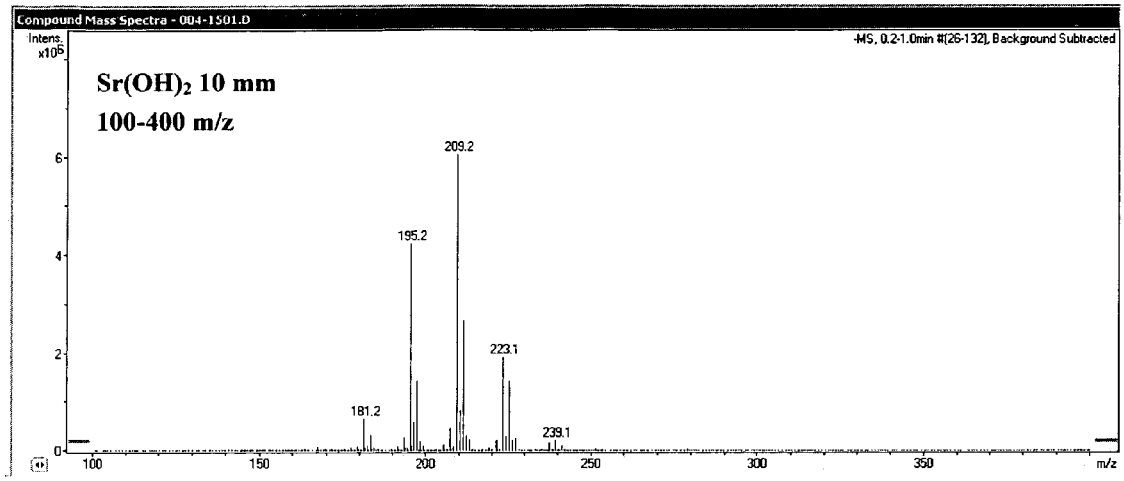
FIG. 4 shows the mass spectrum of a solution comprising ARN acids and lighter acids after it has passed through 10 mm $Sr(OH)_2$.
Figure 4:
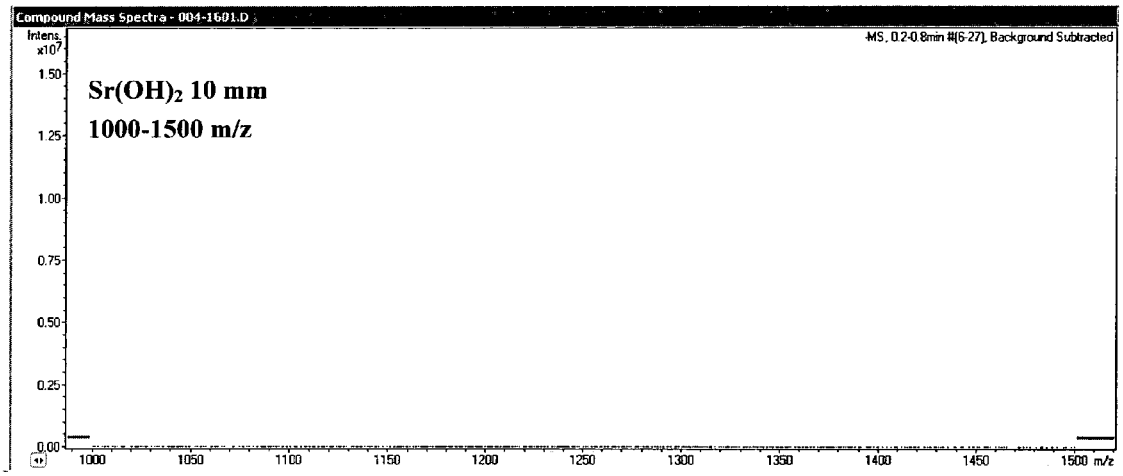
Figure 5:
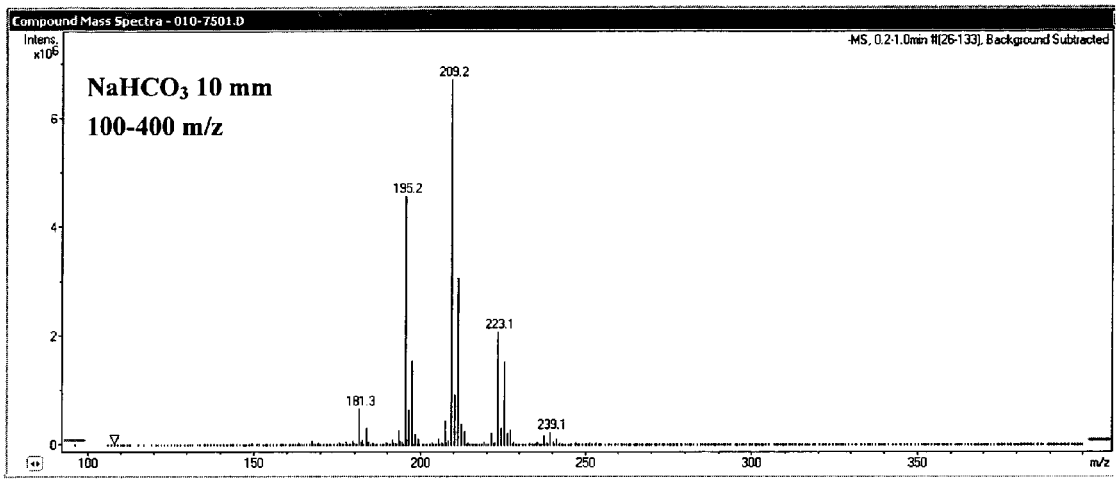
FIG. 5 shows the mass spectrum of a solution comprising ARN acids and lighter acids after it has passed through 10 mm $NaHCO_3$.
Figure 5:
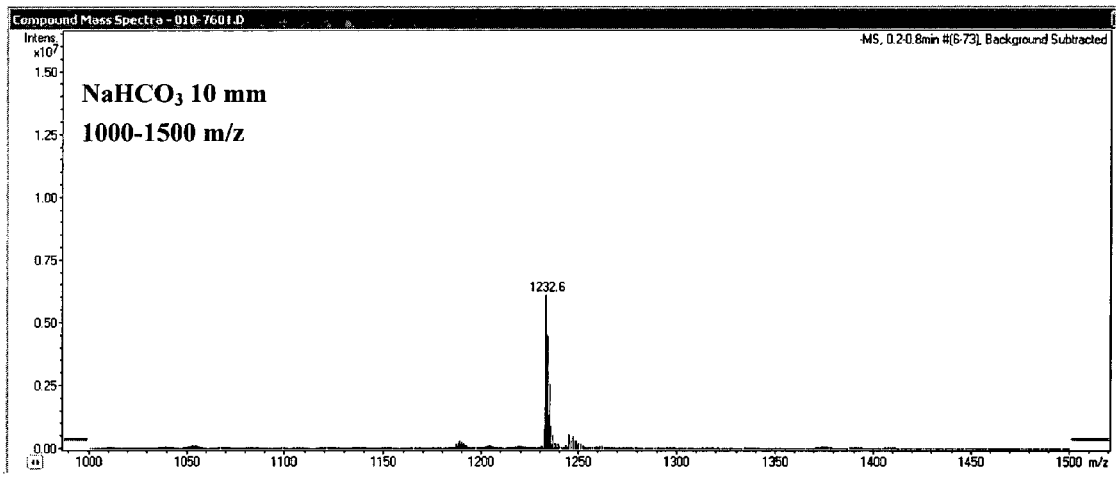
Figure 6:
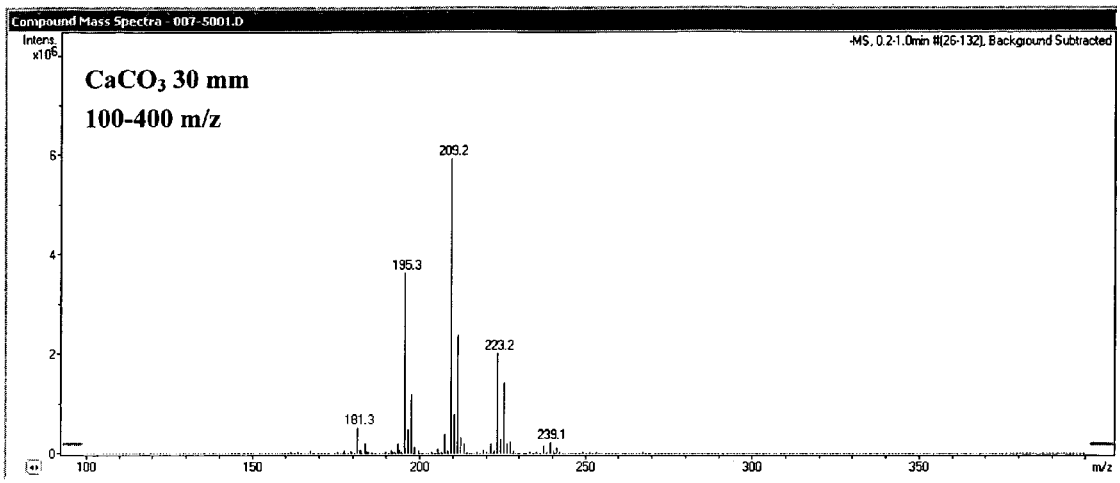
FIG. 6 shows the mass spectrum of a solution comprising ARN acids and lighter acids after it has passed through 30 mm $CaCO_3$.
Figure 6:
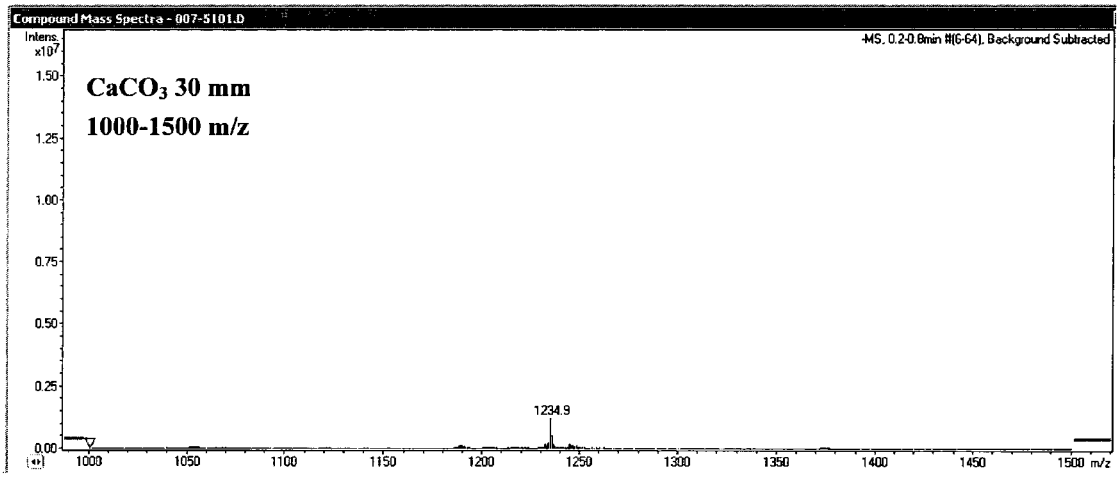
Figure 7:
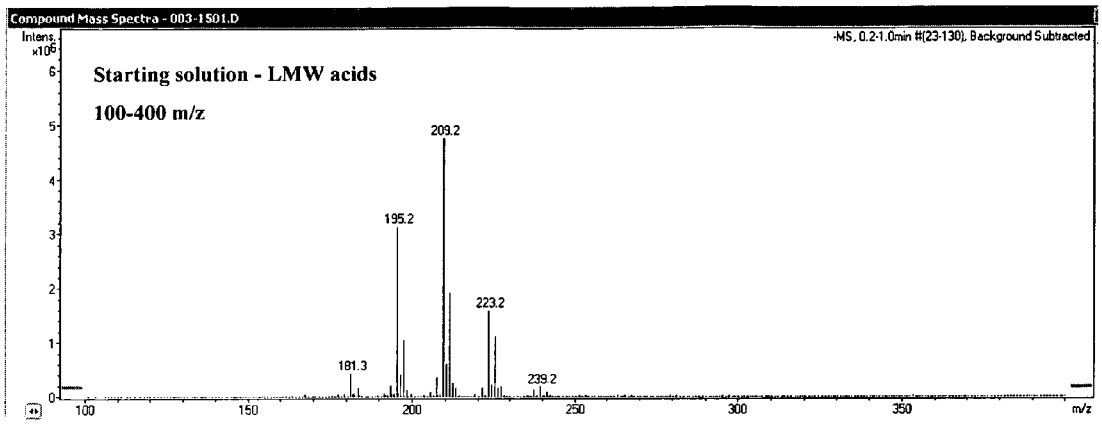
FIG. 7 shows the mass spectrum of the solution before it has passed through the absorbent represented by FIGS. 3-6.
Figure 7:
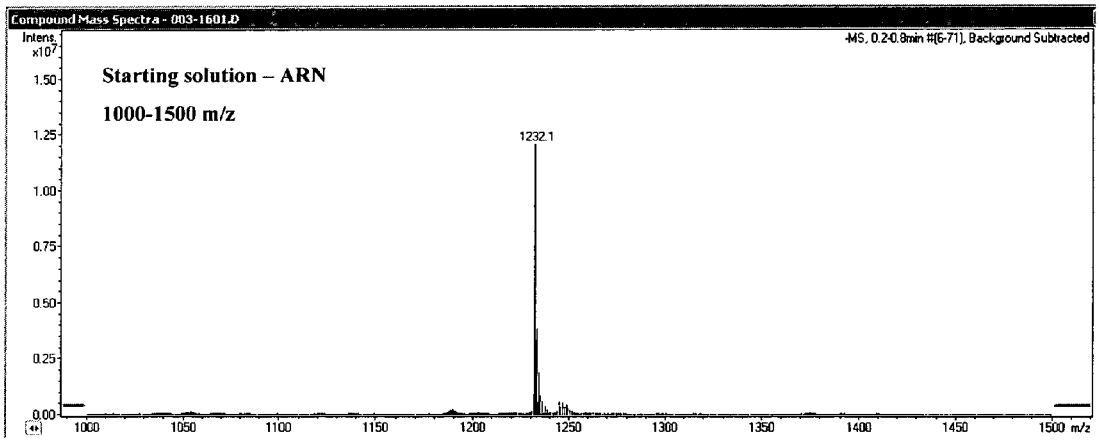

Tests of different solid media (absorbents/adsorbents) where performed by allowing a solution comprising ARN acids (200 mg/kg solvent) and lighter carboxylic acids (1 g/kg solvent) to pass through a test tube filled up to a certain height with the solid medium to be tested, and analyzing the mass spectrum of the solution that has past the solid medium. Some of the obtained test results are shown on FIG. 3-6. In the figures, the upper graph shows the mole weight area where the LMW acids would be detected, and the lower graph shows the mole weight area where the Arn acids would be detected. FIG. 7 shows the mass spectrum for the LMW acids and the ARN acids before they have passed through any solid media. FIG. 3 shows the mass spectrum of a solution comprising ARN acids and lighter acids after it has past through 10 mm $Ca(OH)_2$, all ARN acids have been absorbed by the $Ca(OH)_2$ but the lower acids are still present, i.e., the $Ca(OH)_2$ has selectively absorbed the ARN acids but not the lower acids. FIG. 4 shows the mass spectrum of a solution comprising ARN acids and lighter acids after it has past through 10 mm $Sr(OH)_2$. The $Sr(OH)_2$ has selectively absorbed the ARN acids but not the lower acids. FIG. 5 shows the mass spectrum of a solution comprising ARN acids and lighter acids after it has past through 10 mm $NaHCO_3$. Some of but not all of the ARN acids have been absorbed by this solid medium. FIG. 6 shows the mass spectrum of a solution comprising ARN acids and lighter acids after it has past through 30 mm $CaCO_3$. Here the height of solid medium has been tripled compared to the other illustrated experiments. A main part of the ARN acids are absorbed but a small amount of ARN acids are still contained in the solution after it has been in contact with the solid medium; hence, the medium is not as efficient as the above described salts in absorbing the ARN acid selectively.

EXAMPLES

The following examples show result obtained when quantifying ARN-acids in a sample utilizing the method according to the present invention.

Table 1

Isolation efficiency/ARN acid recovery from spiked crude oil and toluene solutions by application of the present method using $Ca(OH)_2$ as absorbent. APPI-MS was the detection method used to quantify ARN, cf. point 8 above. The amount of $Ca(OH)_2$ used in example no. 1, 3 and 5 was 1 gram, in example no. 2 and 4 was 2 grams. In example no. 1, 3 and 5 the $Ca(OH)_2$ was added to the medium and diluent mixture and shaken over night before the separation of the solids. In example 2 and 4 the mixture of medium and diluent was past through the $Ca(OH)_2$ placed within a column.

| Example no. | Medium | Amount medium | Amount toluene for dilution | Amount ARN added | Amount ARN recovered | Recovery percent |
|---|---|---|---|---|---|---|
| 1 | Crude oil | 40 g | 40 g | 51.5 ppm | 44.3 ppm | 86% |
| 2 | Crude oil | 20 g | 20 g | 5.9 ppm | 5.3 ppm | 90% |
| 3 | Crude oil | 100 g | 100 g | 4.8 ppm | 4.4 ppm | 92% |
| 4 | Crude oil | 30 g | 30 g | 1.4 ppm | 1.0 ppm | 74% |
| 5 | Toluene | 100 g | 0 g | 4.8 ppm | 5.2 ppm | 107% |

The invention claimed is:

1. A method for isolation and quantification of ARN acids in a crude oil sample comprising a) bringing the crude oil sample in contact with a solid ARN absorption/adsorption medium, b) separating the solids from the remaining crude oil sample after the ARN acids have been absorbed by or adsorbed on the solids, c) washing the solids with an organic solvent, d) bringing the solids in contact with a mixture of acidified water or other acid and an organic solvent to release the ARN acids into the organic solvent, e) separating the organic phase from the remains of the solids and any aqueous or other acid used in step d), and f) quantification of the ARN acids in the organic phase.

2. The method according to claim 1, the method further comprising diluting the crude oil sample before it is brought in contact with the solid selective ARN absorption medium.

3. The method according to claim 1, wherein the organic solvent is toluene or xylene.

4. The method according to claim 1, wherein at least a part of the organic solvent is removed before step f) is performed.

5. The method according to claim 1, wherein step d) is repeated one or more times before step e) is performed.

6. The method according to claim 1, wherein the solid ARN absorption/adsorption medium is selected from the group consisting of hydroxides of alkaline earth metals, alkali metals, or transition metals.

7. The method according to claim 1 wherein the solid ARN absorption/adsorption medium is selected from the group consisting of oxides of alkaline earth metals, alkali metals, or transition metals.

8. The method according to claim 1 wherein the solid ARN absorption/adsorption medium is selected from the group consisting of carbonates or bicarbonates of alkaline earth metals, alkali metals and transition metals, other basic transition metal salts, silica, modified silica, or sephadex.

9. The method according to claim 1 wherein the solid ARN absorption/adsorption medium is CaO or $Ca(OH)_2$.

10. The method according to claim 1, wherein the solids are dissolved in step d).

11. The method according to claim 1 further comprising derivatising the ARN acids to esters or other non-acids before step f).

12. The method according to claim 11, wherein at least part of the organic solvent is removed before the step of derivatising.

* * * * *